US005607120A

United States Patent [19]

Folsom

[11] Patent Number: 5,607,120

[45] Date of Patent: Mar. 4, 1997

[54] PAPER ROLL HOIST AND UNWIND ASSEMBLY

[75] Inventor: James C. Folsom, Sanford, Me.

[73] Assignee: Moore Business Forms, Inc., Grand Island, N.Y.

[21] Appl. No.: 477,666

[22] Filed: Jun. 7, 1995

[51] Int. Cl.[6] ..... B65H 19/10

[52] U.S. Cl. ..... 242/559.4; 242/564.5

[58] Field of Search ..... 242/559.4, 420.2, 242/420.3, 533, 414, 564.3, 564.5, 555.7

[56] References Cited

U.S. PATENT DOCUMENTS

| | | | |
|---|---|---|---|
| 13,672 | 1/1914 | Pfister | 242/559.4 X |
| 1,672,320 | 6/1928 | James . | |
| 1,742,029 | 12/1929 | Fallot . | |
| 1,812,742 | 6/1931 | Fallot . | |
| 2,032,339 | 2/1936 | Ball . | |
| 2,037,353 | 4/1936 | Tornberg . | |
| 2,620,994 | 12/1952 | Bennett | 242/420.2 |
| 2,641,413 | 6/1953 | Bruestle | 242/559.4 X |
| 2,984,429 | 5/1961 | Huck . | |
| 3,073,539 | 1/1963 | Brown | 242/559.4 |
| 3,394,897 | 7/1968 | Martin, Sr. . | |
| 3,452,945 | 7/1969 | Viegas . | |
| 4,026,486 | 5/1977 | Law . | |
| 4,729,519 | 3/1988 | Tafel et al. | 242/420.3 X |
| 4,893,763 | 1/1990 | Wales et al. . | |
| 4,951,894 | 8/1990 | Young, Jr. et al. . | |
| 5,000,394 | 3/1991 | Wales et al. . | |
| 5,002,235 | 3/1991 | Greer et al. . | |
| 5,025,998 | 6/1991 | Hutzenlaub . | |
| 5,156,350 | 10/1992 | Wales et al. . | |
| 5,246,180 | 9/1993 | Berry, III et al. | 242/559.4 X |
| 5,282,583 | 2/1994 | Hogberg . | |
| 5,316,231 | 5/1994 | Thievessen et al. . | |
| 5,425,511 | 6/1995 | Pepe | 242/559.4 X |

OTHER PUBLICATIONS

Moore Roll Processing System Brochure.

Moore Service Manual for the 8600 Rollfeed; 145–00562A; Issued 860130.

*Primary Examiner*—Katherine Matecki
*Assistant Examiner*—William A. Rivera
*Attorney, Agent, or Firm*—Nixon & Vanderhye P.C.

[57] ABSTRACT

The roll feed assembly includes a frame mounting a pair of vertical guides carrying vertically movable hoist assemblies. Each hoist assembly is motor-driven by a chain fixed at its opposite ends and disposed about a drive sprocket, and an idler sprocket carried by the frame. Each chain is also disposed about an idler sprocket and idler posts carried by the hoist assembly whereby rotary movement of the drive sprocket in opposite directions causes the hoist assembly to be raised or lowered along the vertical guide thereby raising the lowering the roll. A roll web tension and drive assembly is movable toward and away from the roll and carries a web for driving the roll. The roll web tension and drive assembly includes a roll drive movable therewith for engaging and driving the roll.

8 Claims, 4 Drawing Sheets

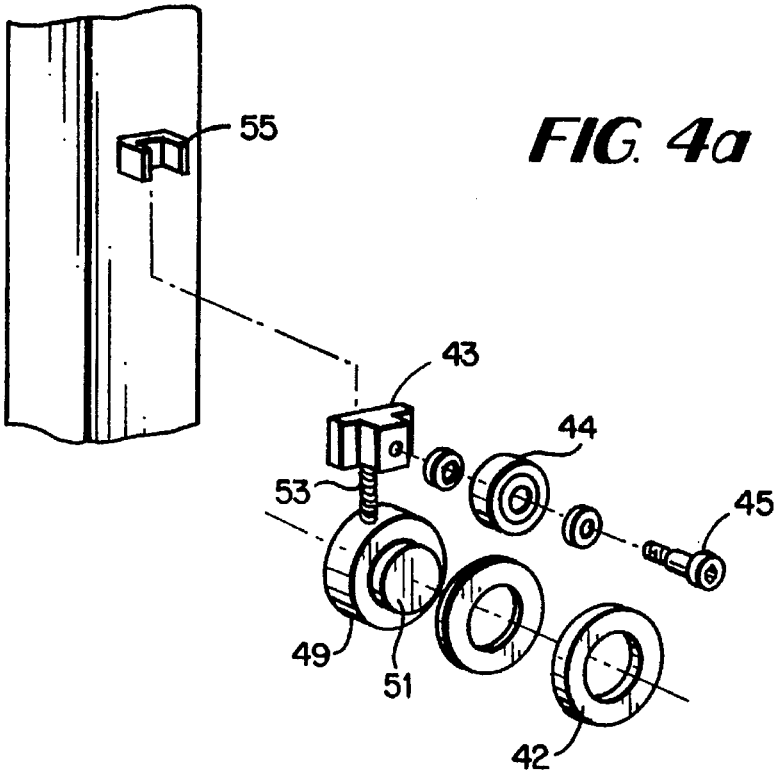
FIG. 4a
FIG. 4b
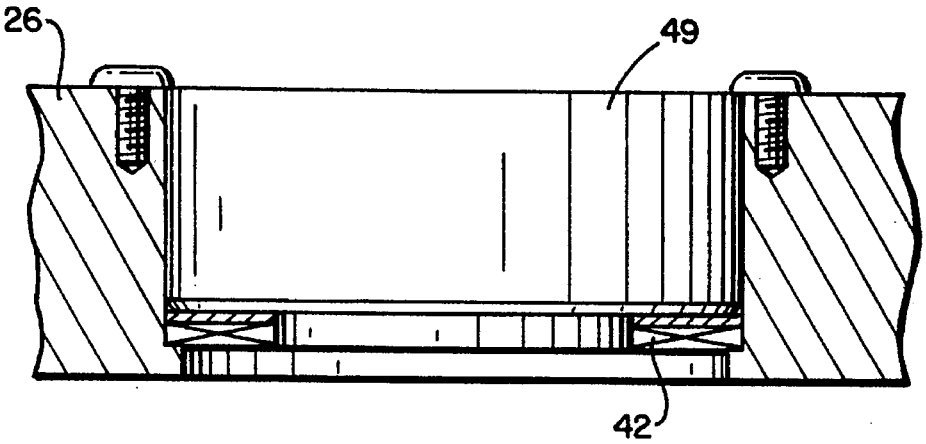

PAPER ROLL HOIST AND UNWIND ASSEMBLY

TECHNICAL FIELD

The present invention relates to a roll feed assembly for elevating, supporting and feeding a web product from a roll thereof and particularly relates to a roll feed assembly having a unique hoist system for elevating a roll and drive system enabling the roll to be fed at high speed.

BACKGROUND

Machines for elevating, supporting and feeding web products, for example, paper from a roll, have been constructed in the past. Stringent requirements must necessarily be met for feeding web products from rolls at high speeds, particularly in view of the nature and weight of the web product. For example, it is desirable to feed a paper roll 52 inches in diameter, 19 inches wide, and weighing up to 1400 pounds on demand from downstream processing units and at speeds up to 600 feet per minute. These requirements necessitate a particularly robust machine which is relatively simple and failsafe in construction.

DISCLOSURE OF THE INVENTION

In accordance with the present invention, there is provided a roll feed assembly comprised of a frame having along opposite sides a pair of vertical guides and a pair of horizontal guides. The vertical guides are located adjacent an open end of the frame for receiving a roll containing the web product. A hoist assembly is provided on each vertical guide and includes a carriage mounted for generally vertical movement along each vertical guide. Each carriage includes a support for an arbor shaft of a roll containing the web product, e.g., a roll of paper. The support includes a pair of bearings for vertically supporting an end of the arbor shaft, an axial thrust bearing for accommodating axial thrust loads on the arbor shaft and a movable bearing for capturing in conjunction with the pair of bearings the end of the arbor shaft. The carriage of each hoist assembly also carries an idler sprocket. Drives for the hoist assemblies are provided and include a chain on each side of the frame essentially fixed at its opposite ends. Each chain has intermediate portions disposed about the idler sprocket of the corresponding carriage and a pair of idler rollers on the frame. An additional idler sprocket is fixed to each side of the frame at an elevation above the maximum height of the axis of the roll when disposed on the roll feed assembly. With the opposite ends of each chain essentially fixed, a drive sprocket, also fixed to the frame, raises and lowers the carriages in response to rotation of the drive sprocket in opposite directions, respectively. That is, to elevate the carriages, each carriage takes on chain from the elevated fixed end of the chain, while giving up chain to the opposite lower fixed end thereof.

The drive sprockets for the hoist assembly are coupled by an additional chain drive to a jack shaft. The jack shaft is driven by a motor which drives a worm/gear combination. By using a worm/gear combination, the weight of the load cannot drive the hoist assembly drive in the opposite direction.

Disposed between the sides of the frame is a web tension and drive assembly mounted for movement along the horizontal guides in directions toward and away from the roll between the carriages of the hoist assembly. Particularly, opposite ends of chains are secured to the horizontally movable carriages mounted for movement along the horizontal guides. A second motor drives the chains whereby the horizontal carriages and hence the web tension and drive assembly are displaced toward and away from the roll. The web tension and drive assembly also includes a roll drive assembly, preferably comprised of an endless belt mounted for movement between a pair of vertically spaced rollers. A third motor carried by the web tension and drive assembly drives the endless belt. By displacing the web tension and drive assembly such that the belt engages the face of the roll and by adjusting the speed of the third motor, the endless belt may drive the roll at a desired speed, while maintaining control over the roll by the pressure applied by the belt against the roll. Additionally, the horizontally movable carriages carry a pair of cross support bars. The roll drive including the endless belt, vertically spaced roller and third motor are displaceable in a lateral direction to adjust the location of the engagement of the web and the roll in accordance with the width of the roll.

In a preferred embodiment according to the present invention, there is provided a roll feed assembly for feeding a web product from a roll having a support shaft, comprising a frame having a pair of generally vertically extending guides and a pair of generally horizontally extending guides, a pair of hoist assemblies mounted for generally vertical movement along the pair of vertical guides, respectively, each hoist assembly including a support for supporting an end of the roll support shaft and a first sprocket rotatable relative to the hoist assembly, a drive for each hoist assembly including (i) a chain substantially fixed at its opposite ends to the frame with intermediate portions thereof engaging the hoist assembly, one intermediate portion of the chain being disposed about the first sprocket, (ii) a drive sprocket rotatably carried by the frame and coupled to the chain, and (iii) a motor coupled to the drive sprocket for driving the drive sprockets and displacing the hoist assemblies along the vertical guides whereby the roll carried thereby is vertically displaced, a web tension and drive assembly carried by the frame for movement along the horizontal guides toward and away from the roll carried by the hoist assemblies and including an element engageable with the roll for rotating the roll, a motor coupled to the web tension and drive assembly for moving the web tension and drive assembly along the frame and a third motor coupled to the element for driving the element and thereby rotating the roll to feed web product therefrom.

Accordingly, it is a primary object of the present invention to provide a novel and improved roll feed assembly for elevating, supporting, feeding and controlling the tension on the web fed from the roll.

Figure 5:
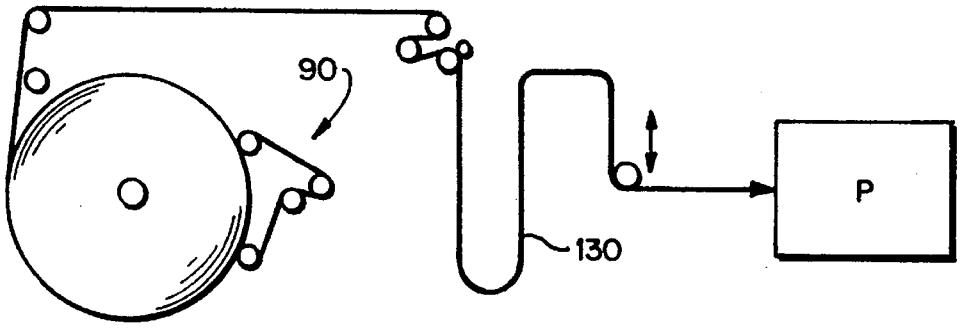

FIG. **4*a*** is a fragmentary perspective view of an arbor shaft end capture assembly;

FIG. **4*b* is a fragmentary enlarged cross-sectional view of the capture assembly of FIG. 4*a*; and FIG. 5** is a schematic illustration of the web tension and drive assembly bearing against the roll and the web product being fed from the roll.

BEST MODE FOR CARRYING OUT THE INVENTION

Figure 1:
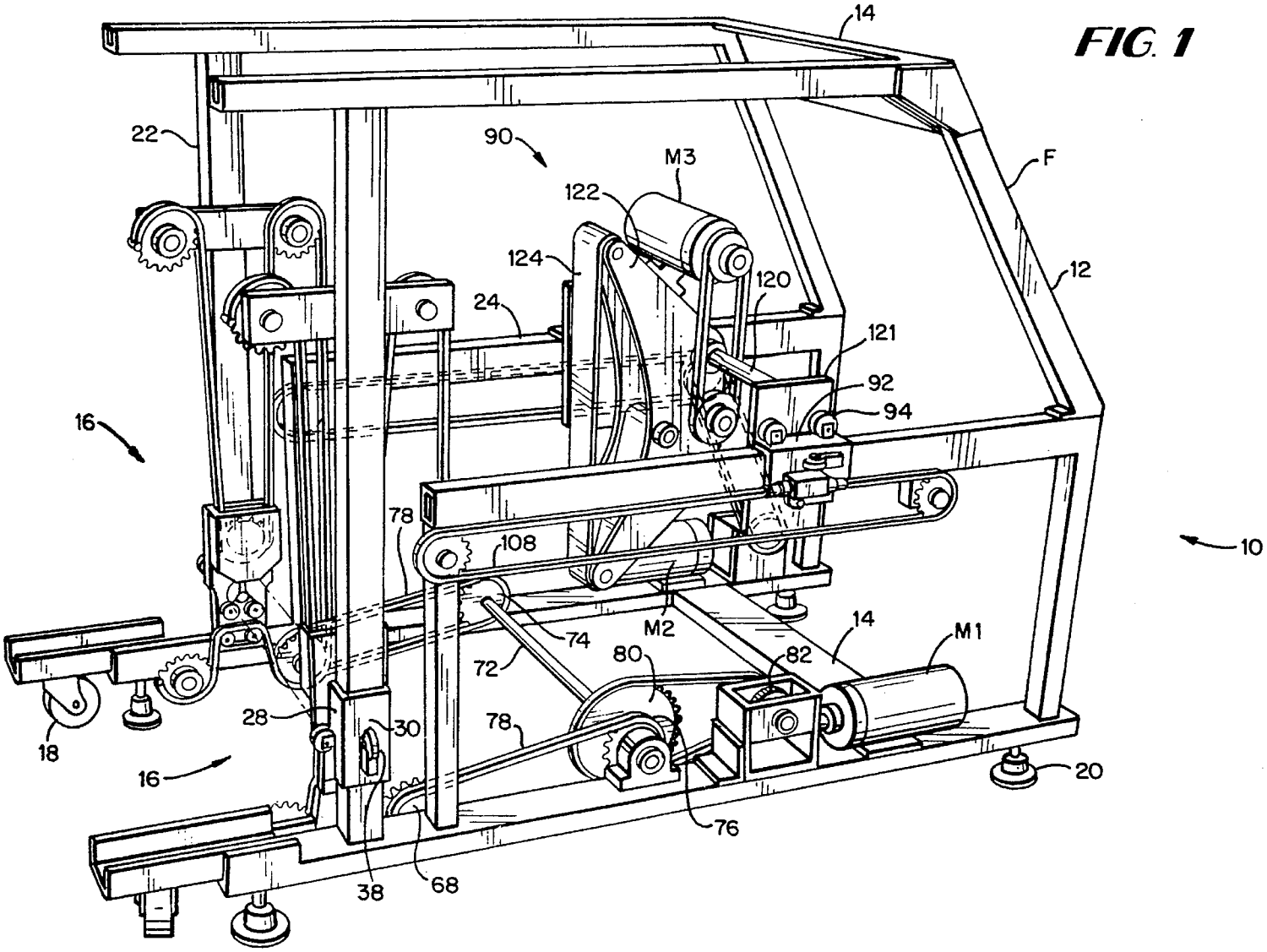
FIG. 1 is a perspective view of a roll feed assembly according to the present invention.

Referring now to FIG. 1, there is illustrated a roll feed assembly according to the present invention, generally designated 10, and including a frame F having side frame members 12 interconnected by cross frame members 14. As illustrated, the frame is open at its forward end for receiving a roll of web product, e.g., paper, between the side frames 12 and between hoist assemblies, generally designated 16. The frame 12 may be mounted on casters 18 and carries extensible feet 20 for fixing the frame 12 in a predetermined location. The frame 12 includes a pair of laterally spaced, vertically extending guides 22, as well as a pair of laterally spaced, generally horizontally extending guides 24. The guides 22 and 24 form structural parts of the frame 12.

Figure 3:
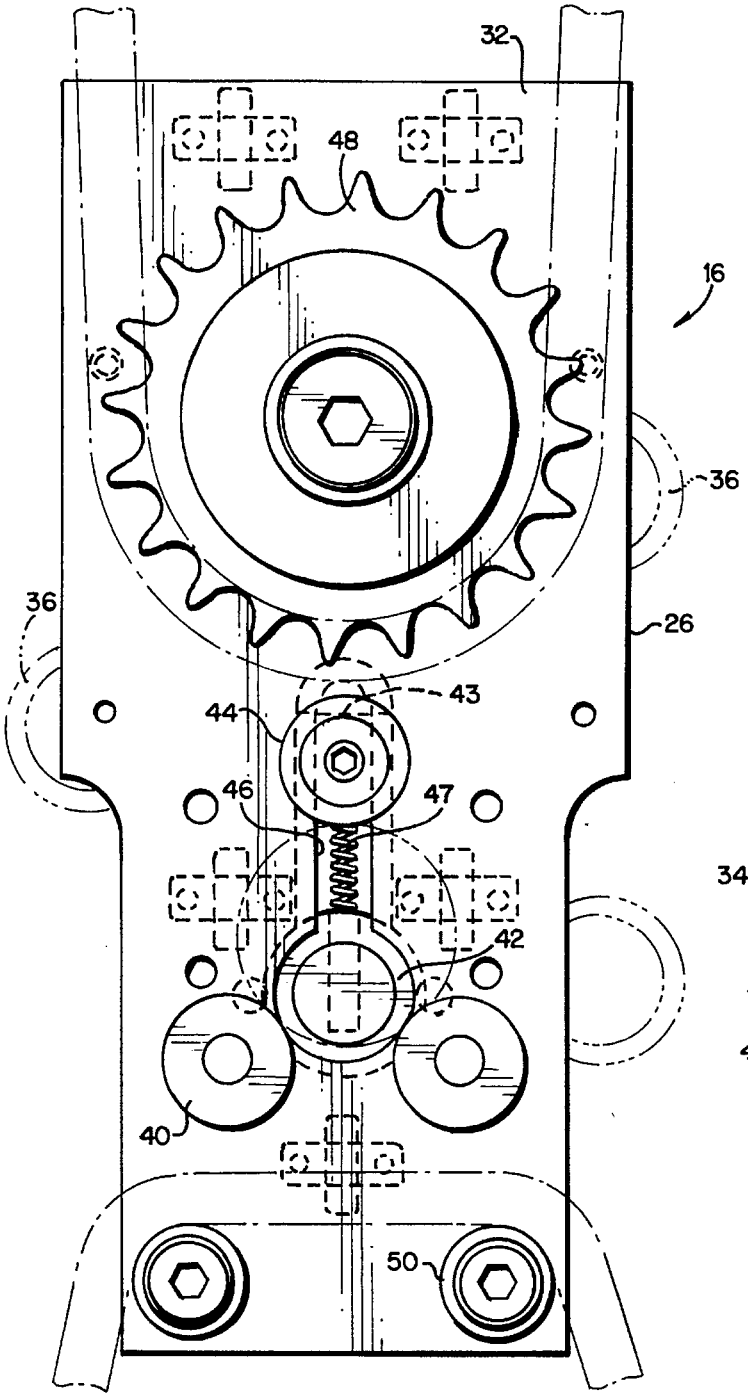
FIG. 3 is an enlarged elevational view of a hoist assembly.
Figure 4:
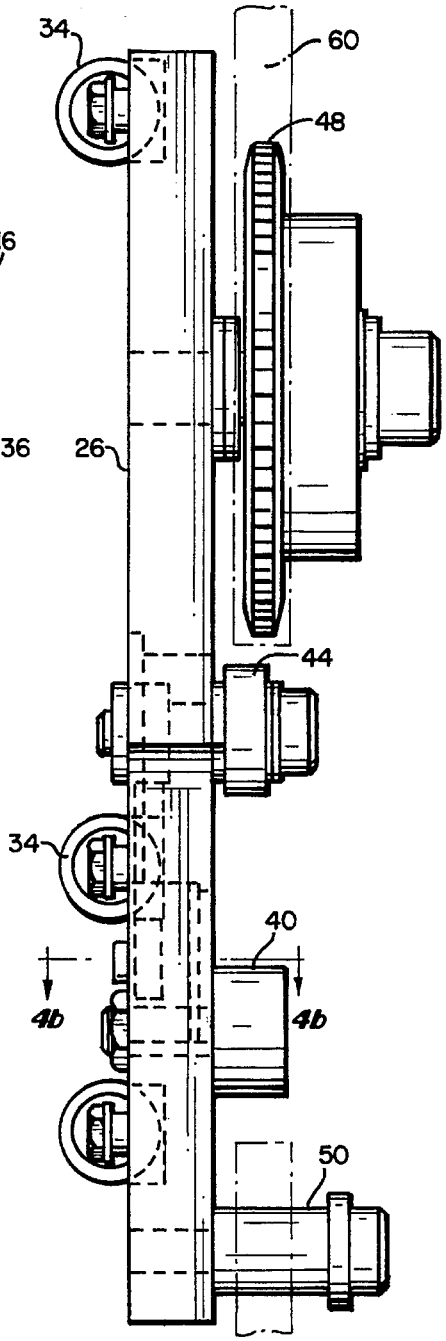
FIG. 4 is a side elevational view thereof.

As will be appreciated, each hoist assembly 16 is mounted for vertical movement along a vertical guide 22 and supports an end of the arbor shaft passing through the axis of the roll disposed in the open end of the frame 12. Referring to FIG. 3, each hoist assembly 16 includes a carriage comprising an enclosure 28 mounted for sliding movement along a guide 22. Enclosure 28 includes a back support plate 30 secured to an inner plate 32. The inner plate, as illustrated in FIGS. 3 and 4, mounts a plurality of bearings 34 for rolling engagement along the inside face of vertical guides 22. The outer plate 30 has a plurality of rollers 36 mounted along opposite sides thereof, as well as a roller 38 (FIG. 1) projecting through the plate 30 for engagement along the sides and outside surface of vertical guides 22. In this manner, each carriage 26 is mounted for movement along a vertical guide 22.

Each carriage 26 includes a pair of cam followers 40 lying on opposite sides of an axial thrust bearing 42. The thrust bearing accommodates any axial thrusts of the arbor shaft carrying the roll, e.g., when the shaft is slightly out of transverse alignment. A third cam follower 44 is (FIGS. 3 and 4*a*) mounted on a T-nut 43 for slidable movement in a T-slot 46 of the carriage 26, the mounting being effected by a shoulder bolt 45. A roll pin 47 extends from T-nut 43 and captures one end of a spring 53, the lower end of which extends into an opening in a disk 49 behind thrust bearing 42. The thrust bearing 42 is carried on a journal pin 51 carried by disk 49. The disk 49 therefore secures the bottom of compression spring 53 and secures the thrust bearing 42 while permitting the thrust bearing to rotate. The cam follower 44 is therefore mounted for sliding movement toward and away from the arbor shaft and it will be appreciated that the spring 53 maintains the T-nut 43 and cam follower 44 adjacent the top of the T-slot 46.

It will also be appreciated that the end of the arbor shaft may be captured between the three cam followers 40 and 44 when the cam follower 44 and carriage 26 are relatively displaced to engage cam followers 40 and 44 about the shaft end. To accomplish this, an actuator 55 (FIG. 4*a*) is vertically adjustably mounted on the vertical guide 22. The actuator 55 is preferably a U-shaped bracket located on guide 22 just below the upper extent of travel of hoist assembly 16. As the hoist assembly moves upwardly along the guide 22, actuator 55 engages the T-nut 43, stopping its upward travel while the hoist assembly 16 continuously moves upwardly. This relative motion difference causes the lower cam followers 40 carrying the arbor shaft end to close with the upper cam follower 55 until the arbor shaft contacts cam follower 44. Simultaneously, a limit switch is actuated to stop the upward movement of the hoist assembly 16 as described below. Downward movement of the hoist assembly causes the cam followers 40 to move away from cam follower 44 as the spring 53 maintains T-nut 43 in contact with actuator 55. As the hoist assembly 16 moves further downwardly, the T-nut 43 disengages from the actuator 55 and is retained in the upper end of the T-slot by spring 53. This frees the arbor shaft from its captured position between cam followers 40 and 44.

Carried by and adjacent the upper end of carriage 26 is an idler sprocket 48. At the lower end of carriage 26, a pair of idler posts 50 are spaced longitudinally one from the other and below the cam followers 40.

Figure 2:
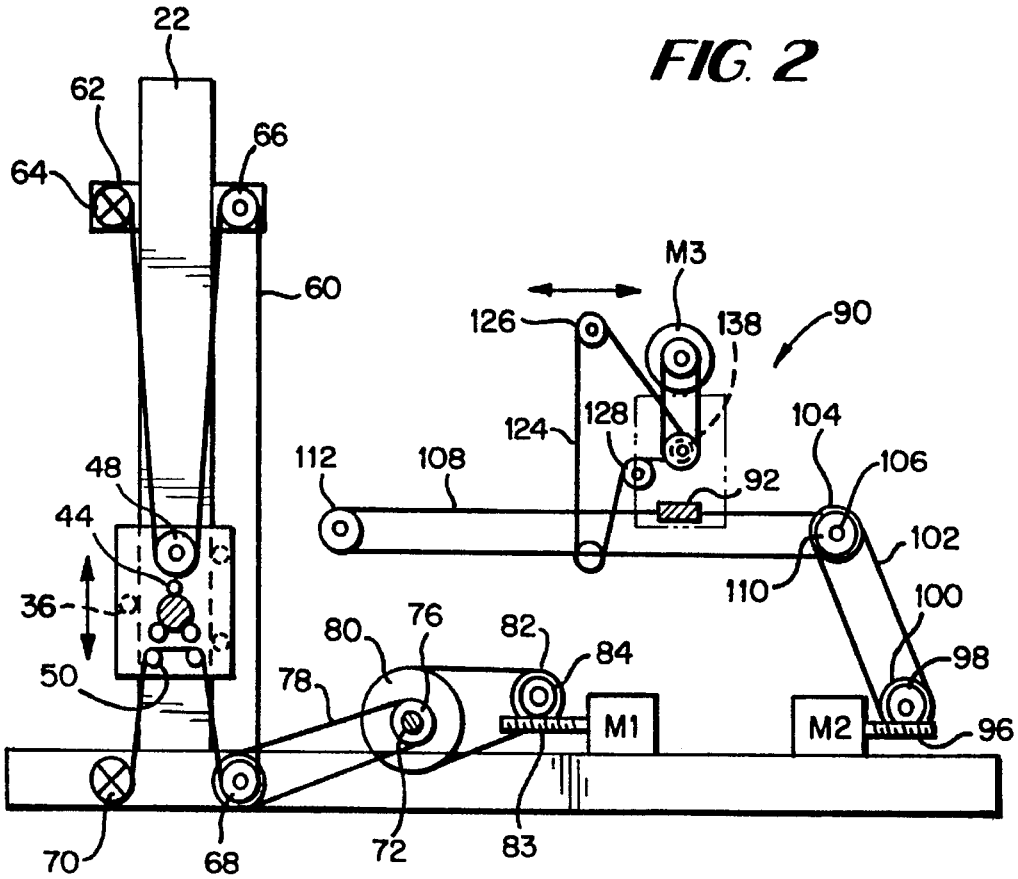
FIG. 2 is a schematic side elevational view illustrating the drive for the hoist assemblies and the web tension and drive assembly.

As best illustrated in FIGS. 1 and 2, a drive for raising and lowering each hoist assembly 16 is provided. The drive comprises for each hoist assembly a chain 60, one end of which is fixedly mounted to a fixed sprocket 64 fixed to a support 62 adjacent an upper end of guide 22. The chain 60 is disposed about the idler sprocket 48 of the hoist assembly 16 and is disposed about another idler sprocket 66 mounted on support 62. The chain extends from sprocket 66 about one set of sprocket teeth of a double sprocket 68 fixed to the lower side of the frame. The chain 60 extends from sprocket 68 over the idler posts 50 of the hoist assembly and is then fixed to a spring-loaded sprocket 70, carried for limited rotational movement by the frame 12.

Also as illustrated in FIGS. 1 and 2, a jack shaft 72 extends between opposite sides of the frame and carries a pair of sprockets 74 and 76 at opposite ends. The sprockets 74 and 76 have endless chains 78 which engage about the other sprocket of the double sprockets 68. A large sprocket 80 is disposed on jack shaft 72 and is chain-driven from a gear 82. A motor M1 drives a worm 83 (FIG. 2) in engagement with the gear 84 on the common shaft.

As a consequence of this arrangement, it will be appreciated that the double sprockets 68 are rotated by motor M1 through the worm 83, gear 84, sprocket 82, sprocket 80, sprockets 76 and 74 and chains 78. By driving the double sprocket 68 of each hoist assembly, for example, in a clockwise direction as illustrated in FIG. 2, the fixed rotating sprocket 68 will take up chain from sprockets 48 and 66, causing the hoist assembly 16 to be raised along the guide 22. Simultaneously, each sprocket 68 gives up chain to the idler posts 50 as the hoist assembly is elevated. Each sprocket 70 is spring-loaded to yield additional chain to the hoist assembly when the latter is adjacent the bottom of its vertical travel. Also, note that the hoist assembly 16 in FIG. 2 is elevated above the lower portion of the frame and particularly the sprockets 68 and 70. The sprockets 68 and 70, however, are spaced apart sufficiently such that the hoist assembly can be lowered between the sprockets. By driving the chains 60 by motor M1 as discussed above, the hoist assemblies 16 are raised along guides 22 until a limit switch, not shown, is actuated, which deenergizes motor M1. At that time, the roll has been raised to a maximum elevation relative to the frame. By reversing the motor M1, the double sprockets 68 are driven such that chains 60 are taken up from the idler posts 40 and passed back to the sprockets 66 and 48, thereby lowering hoist assemblies 16 along guides 22.

Also mounted on frame 12 is a web tension and drive assembly, generally designated 90, for rotating the roll and applying a tension to the roll. The assembly 90 is mounted along the horizontal guides 24 for movement in directions toward and away from the open end of the frame 12, i.e., toward and away from the roll mounted between the hoist assemblies 16. To accomplish this, the assembly 90 includes a pair of carriages 92 along respective opposite sides of the frame. The carriages essentially envelope the guides 24 and carry bearings 94 along top, bottom and sides of the carriages for bearing engagement along guides 24 whereby the carriages are movable toward and away from the roll. To move the carriages and hence the web tension and drive assembly 90 along guides 24, a motor M2 is mounted on the frame and drives a worm 96 (FIG. 2) engaging a gear 98. Gear 98 drives a sprocket 100 connected by a chain 102 to a second sprocket 104 mounted on the frame 12. A shaft 106 connects sprocket 104 with another sprocket on the opposite side of the frame. A chain 108 is disposed about each of the sprockets 110 and a forward idler sprocket 112 is also mounted on the frame adjacent the forward end of the guide 24. The ends of each chain 108 are secured to the carriage 92 on the respective opposite sides of the frame. Consequently, by actuation of motor M2 and through the worm/gear drive arrangement, the chains 108 advance or retract the web tension and drive assembly 90 toward and away from the roll, respectively.

A pair of shafts 120 extend between support plates 121 carried by the carriages 92 and support mounting plates 122 for an endless belt 124 forming part of a roll drive assembly. The endless belt 124 is mounted about a pair of vertically spaced rollers 126, about an idler roller 128 (FIG. 2) and about a drive shaft 138. Drive shaft 138 is driven by a motor M3 carried by and for movement with the web tension and drive assembly 90. When motor M3 is actuated, the belt 124 is driven in the appropriate direction to feed web product from the roll when the belt is engaged against the roll.

In operation, a roll is disposed between the sides of the frame and between the hoist assemblies 16, with an arbor shaft installed in the roll substantially coincident with the axis of the roll. Motor M1 is actuated to drive the chains 60, raising the hoist assemblies 16 with the ends of the arbor shaft captured between the cam followers. The motor continues to raise the hoist assemblies 16 until the roll center is approximately 27 inches off the floor, at which time the hoist assemblies actuate a limit switch, deactivating motor M1. Motor M2 is then actuated to jog the web tension and drive assembly forwardly until belt 124 is appropriately tensioned against the interior face of the roll. The web product is then threaded about the various rollers downstream of the roll feed assembly (FIG. 5) and through the printing units schematically illustrated at P. Sensors can be used to sense the gravity loop 130 of the web downstream of the roll to drive the roll or remove the drive from the roll. When the loop shortens, the roll may be accelerated by actuation of the motor M3 to drive the roll at the appropriate angular velocity. When the loop is sensed to be long, the sensor deactivates the motor M3.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A roll feed assembly for feeding a web product from a roll having a support shaft, comprising:

a frame having a pair of generally vertically extending guides and a pair of generally horizontally extending guides;

a pair of hoist assemblies mounted for generally vertical movement along said pair of vertical guides, respectively, each hoist assembly including a support for supporting an end of the roll support shaft and a first sprocket rotatable relative to said hoist assembly;

a drive for each said hoist assembly including (i) a chain substantially fixed at opposite ends to said frame with intermediate portions thereof engaging said hoist assembly, one intermediate portion of said chain being disposed about said first sprocket, (ii) a drive sprocket rotatably carried by said frame and coupled to said chain, and (iii) a first motor coupled to said drive sprocket for driving said drive sprocket and displacing said hoist assemblies along said vertical guides whereby the roll carried thereby is vertically displaced;

a web tension and drive assembly carried by said frame for movement along said horizontal guides toward and away from the roll carried by said hoist assemblies and including an element engageable with the roll for rotating the roll;

a second motor coupled to said web tension and drive assembly for moving said web tension and drive assembly along said frame; and a third motor coupled to said element for driving said element and thereby rotating the roll to feed web product therefrom.

2. A roll feed assembly according to claim 1 wherein said drive sprocket engages said chain at a location along said chain between said intermediate portions thereof.

3. A roll feed assembly according to claim 1 wherein each said hoist assembly drive includes an idler sprocket carried by said frame at an elevation above a maximum elevation of said hoist assembly along said vertical guides, said chain being disposed about said idler sprocket at a location therealong between said first sprocket and said drive sprocket, said first sprocket being disposed on said hoist assembly at an elevation above said shaft support and another of said intermediate portions of said chain engaging said hoist assembly at an elevation below said shaft support.

4. A roll feed assembly according to claim 1 wherein each said hoist assembly drive includes an idler sprocket carried by said frame at an elevation above a maximum elevation of said hoist assembly along said vertical guide, said chain being disposed about said idler sprocket at a location therealong between said first sprocket and said drive sprocket, a second spring-loaded sprocket fixedly carrying one end of said chain for yielding additional chain upon actuation of said first motor.

5. A roll feed assembly according to claim 1 including a worm gear drive coupled to said first motor for preventing the roll from driving the worm gear in a direction opposite to a direction for hoisting the roll.

6. A roll feed assembly according to claim 1 wherein said web tension and drive assembly includes a roll drive mounting said element, said element comprising an endless belt for engaging the roll and a carriage for movement along the horizontal guides, chains along opposite sides of said frame disposed about horizontally spaced sprockets and having ends thereof connected to said carriage, said second motor being coupled to said chains through a drive sprocket.

7. A roll feed assembly according to claim 6 wherein each support includes first and second elements for engaging an end of the roll support shaft, said elements being mounted for relative movement between a first position with the first element carrying the roll support shaft end and the second element spaced therefrom and a second position with the first and second elements engaged about and thereby capturing said roll support shaft end.

8. A roll feed assembly according to claim 7 wherein said second element is movable into said second position in response to said hoist assembly obtaining a predetermined elevation along said guide.

* * * * *